US005566857A

United States Patent [19]

Rothman

[11] Patent Number: 5,566,857

[45] Date of Patent: Oct. 22, 1996

[54] DISPENSER

[76] Inventor: Michael Rothman, 37 Grayson La., Newton, Mass. 02162

[21] Appl. No.: 366,624

[22] Filed: Dec. 30, 1994

Related U.S. Application Data

[63] Continuation-in-part of Ser. No. 29,668, Oct. 13, 1994, Pat. No. Des. 366,827, which is a continuation-in-part of Ser. No. 21,528, Apr. 19, 1994, abandoned.

[51] Int. Cl.[6] ..... B65H 1/08

[52] U.S. Cl. ..... 221/229; 221/232

[58] Field of Search ..... 221/229, 228, 221/232, 226, 268, 271, 269, 270, 279

[56] References Cited

U.S. PATENT DOCUMENTS

| | | | |
|---|---|---|---|
| 2,245,066 | 6/1941 | Bouchard | 221/232 |
| 5,178,298 | 1/1993 | Allina | 221/229 |

*Primary Examiner*—Kenneth Noland
*Attorney, Agent, or Firm*—Iandiorio & Teska

[57] ABSTRACT

A dispenser including a container having an open end a mechanism for urging items contained within the container proximate the open end; and a cover including a slot in communication with the open end of the container and also a slidable top portion having a pusher member for dispensing the uppermost item within the container through the slot when the slidable top portion of the cover is extended.

12 Claims, 3 Drawing Sheets

DISPENSER

RELATED APPLICATIONS

This application is a Continuation-in-Part of U.S. Design Patent Application Ser. No. 29/029,668, filed Oct. 13, 1994 now Design Patent No. D366827 which is a Continuation-in-Part of U.S. Design Patent Application Ser. No. 29/021,528, filed Apr. 19, 1994 now abandoned both by the same invention entity.

FIELD OF INVENTION

This invention relates to a dispenser for containing and dispensing confections and pharmaceutical tablets.

BACKGROUND OF INVENTION

Tablet dispensers have long been used to deliver confections and even pharmaceutical tablets. As described in U.S. Pat. No. 2,620,061, the typical dispenser includes a spring loaded container with a lid having a thrust member which, upon opening the lid, presses laterally against the upper most article in the container thus displacing it from its central position within the container and over the container edge. The lid is normally biased closed in order to preserve the contents of the dispenser and for hygienic reasons. See also U.S. Pat. No. 3,942,683.

Improvements of such a dispenser included means for assuring the spring used to push the tablets upward does not jump out when the device is misused thereby causing injury. See U.S. Pat. No. 4,966,305.

No art, however, is directed to improving the lid mechanism to overcome the excessive cost and manufacturing difficulties associated with a pivoting, flip style, spring biased lid and the many component parts associated therewith.

SUMMARY OF INVENTION: I

It is therefore an object of this invention to provide a more easy to manufacture tablet dispenser.

It is a further object of this invention to provide such a dispenser which does not require a pivoting, flip style, spring biased lid.

It is a further object of this invention to provide such a dispenser which is still sealable in order to preserve the contents of the dispenser and for hygienic reasons.

It is a further object of this invention to provide such a dispenser which is easy to use and failsafe to operate.

It is a further object of this invention to provide such a dispenser which requires less component parts and which is less expensive to manufacture than prior art designs.

This invention results from the realization that instead of a pivoting, flip style, spring biased lid with many component parts, a simpler yet still hygienic dispensing mechanism can be constructed from a cover fabricated with a slidable top portion which, when extended, dispenses a tablet or confection and which, when rotated, hygienically seals the contents of the container.

This invention features a dispenser which may suitably comprise, include, consist essentially of or consist of a container having an open end and including means for urging items contained within the container proximate the open end. A cover for the container includes a slot in communication with the open end of the container and a slidable top portion having means, such as a pusher member, for dispensing the uppermost item within the container through the slot when the slidable top portion of the cover is extended. The pusher member is typically integral with the slidable top portion. In a preferred embodiment, there is a recess for receiving the pusher member rendering it flush when the slidable top portion is retracted. Also, the cover is preferably rotatable with respect to the container for covering the slot thereby sealing the items within the container.

There may be means for releasably locking the cover in position whereby the slot is uncovered such as a ball on one of the cover and the container and a complementary detent for receiving the ball on the other of the cover and the container. The slidable top portion of the cover preferably includes a sloped portion with a friction surface.

The means for urging items contained within the container proximate the open end typically includes a liner spring biased to retract within the container and a lift member slidable with respect to the liner, wherein the lift member is spring biased to extend out of the container.

The dispenser of this invention also features means for retaining the liner in an extended position such as a ledge on a bottom portion of the liner and corresponding notches in a top portion of the container.

DISCLOSURE OF PREFERRED EMBODIMENT

Other objects, features and advantages will occur to those skilled in the art from the following description of a preferred embodiment and the accompanying drawings, in which.

Figure 2:
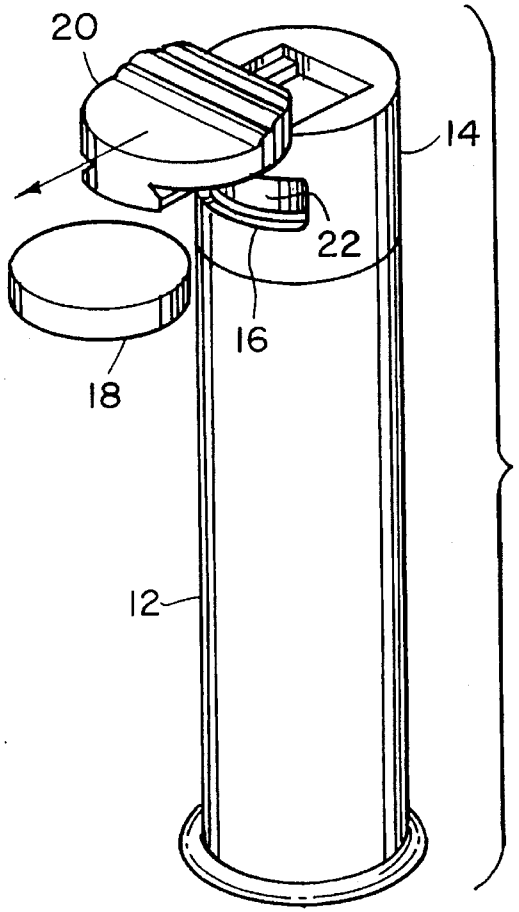
FIG. 2 is a view similar to FIG. 1 except that the slidable top portion of the cover for the container of this invention is shown in the extended position for dispensing a tablet.
Figure 1:
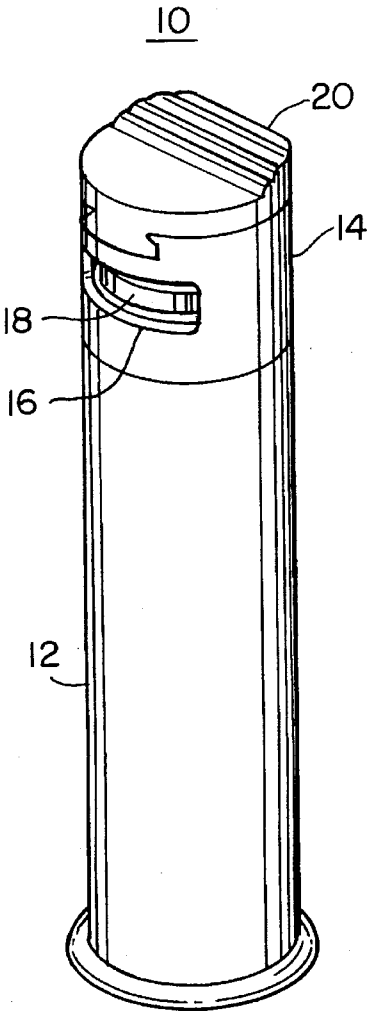
FIG. 1 is a front plan view of the dispenser of this invention showing the slidable top portion in its retracted position.

Dispenser 10, FIG. 1, includes container 12 and cover 14. Cover 14 has a slot 16 through which tablets such as tablet 18 are dispensed. Cover 14 includes slidable top portion 20 shown in FIG. 1 in its retracted position but slidable top portion 20, FIG. 2, extends as shown for discharging tablet 18.

The next tablet 22 in the stack of tablets within container 12 is then urged upwards also to be dispensed as slidable top portion 20 is again moved from the retracted position (FIG. 1) to the extended position (FIG. 2) relative to the remainder of cover 14. The spring mechanism and the other components within container 12 used for urging the tablets upwards are not shown in FIGS. 1–3 but may be similar to the mechanisms disclosed in U.S. Pat. Nos. 4,966,305; 2,620,061, and/or, 3,942,683.

Figure 3:
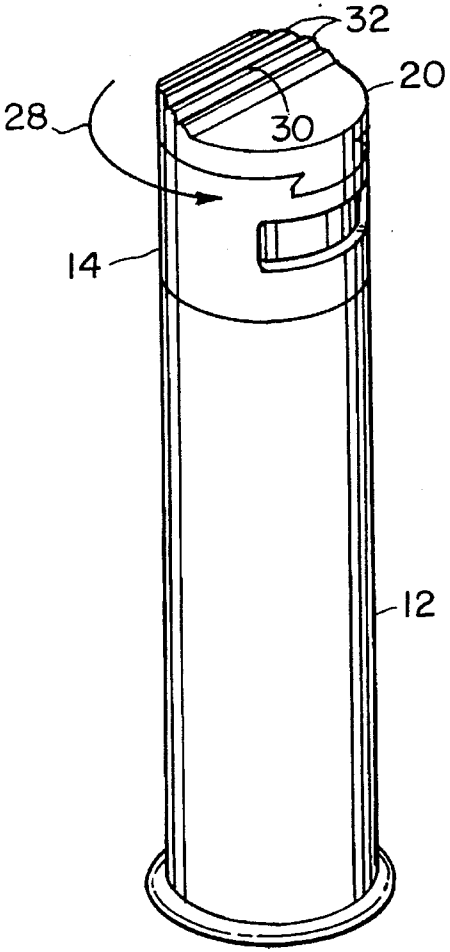
FIG. 3 is a view similar to FIG. 1 except that the cover of this invention is shown in its rotated position for sealing the container.

Another feature of this invention, as shown in FIG. 3, is that cover 14 can be rotated in the direction shown by arrow 28 to cover slot 16 for sealing the items within the container. Dispenser 10 is as hygienic as prior but more complicated pivoting, flip style, spring biased lid dispenser designs.

Sloped portion 30 of slidable top portion 20 makes it easier for the user to slide top portion 20 between the retracted and extended positions. Sloped portion 30 may also include friction surface 32 as shown in FIG. 3.

Figure 5:
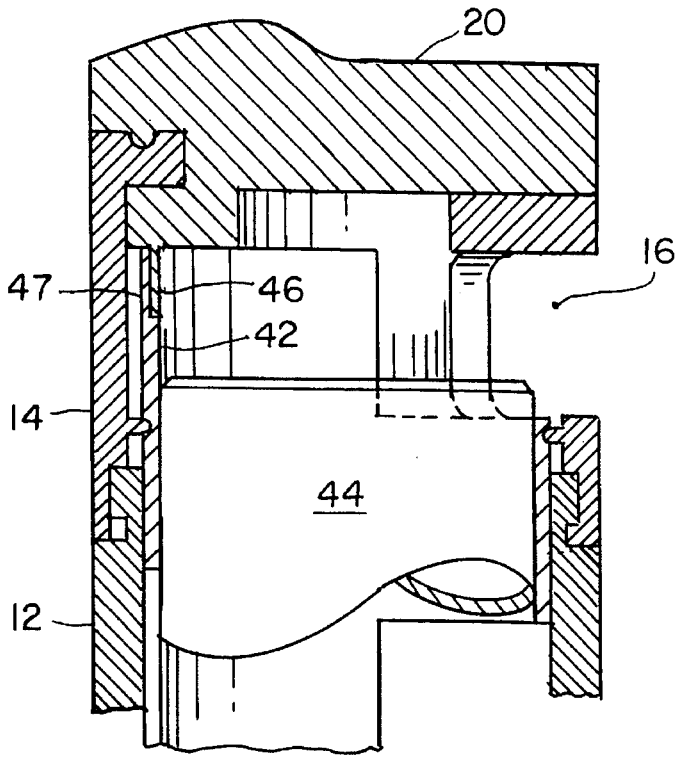
FIG. 5 is a side partial cut away view of the cover portion of the dispenser of this invention with the slidable top portion shown in its retracted position.
Figure 6:
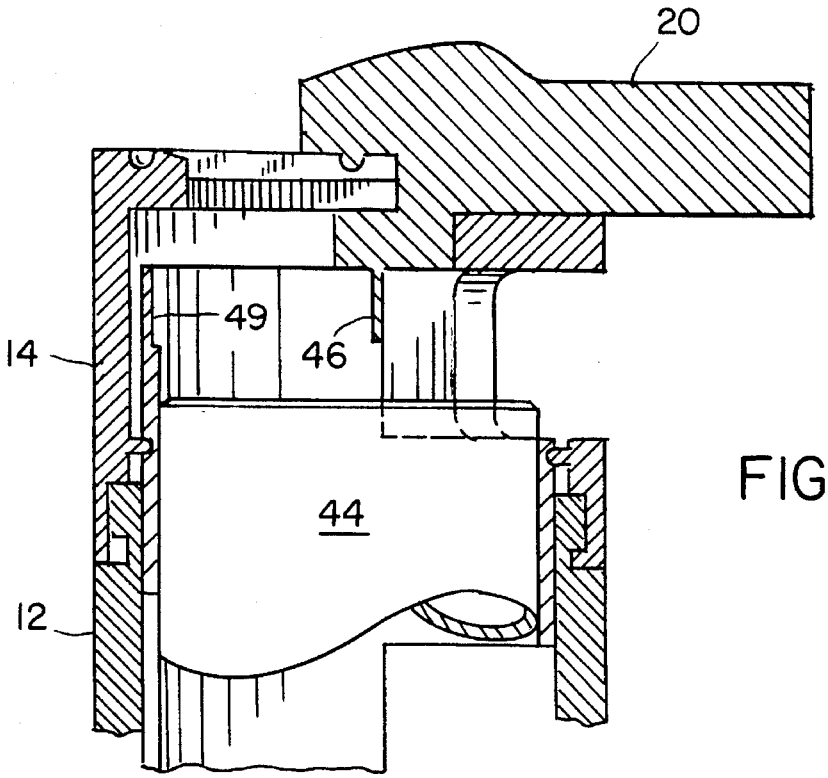
FIG. 6 is a side partial cut away view of the cover of the dispenser of this invention showing the slidable top portion in its extended position for dispensing a tablet.

The operation of the cover for the container of the dispenser of this invention is further described with reference to FIGS. 4–6. Container 12, FIG. 4, has open end 11 and some means for urging items contained within the container proximate open end 11. As discussed above, the means for urging items contained within container 12 proximate open end 11 may include the combination of spring 40, inner sleeve 42, and lift member 44. This type of dispenser generally operates by fixing the bottom of spring 40 to the bottom (not shown) of container 12 and fixing the top of spring 40 to the underside of lift member 44 such that it biases lift member 44 always upwards. In addition, the bottom of inner liner 42 is connected to the bottom of spring 44 to bias liner 42 always downwards. Cover 14 is removably attached in some fashion to liner 42.

The user loads the dispenser by pulling cover 14 upwards which also brings liner 42 upwards. After loading, the user releases cover 14 and spring 40 urges liner 42 and cover 14 downward and the tablets will rest on top of each other on lift member 44 within cover 14. The operation of this mechanism is generally described in the aforementioned patents.

Instead of tile pivoting, flip style, spring biased lid of these prior devices, however, this invention features slidable top portion 14 which is fairly easy to manufacture and assemble. Pusher member 46, FIG. 5, of slidable top portion 20 pushes a tablet on lift member 44 out through slot 16 thereby dispensing the tablet when slidable top portion 20 is extended as shown in FIG. 6. Wall 47 of liner 42, FIG. 5 includes recess 49, FIG. 6, so that pusher member 46 is rendered more or less flush with liner 42 when the top portion 20 is retracted as shown in FIG. 5.

Figure 4:
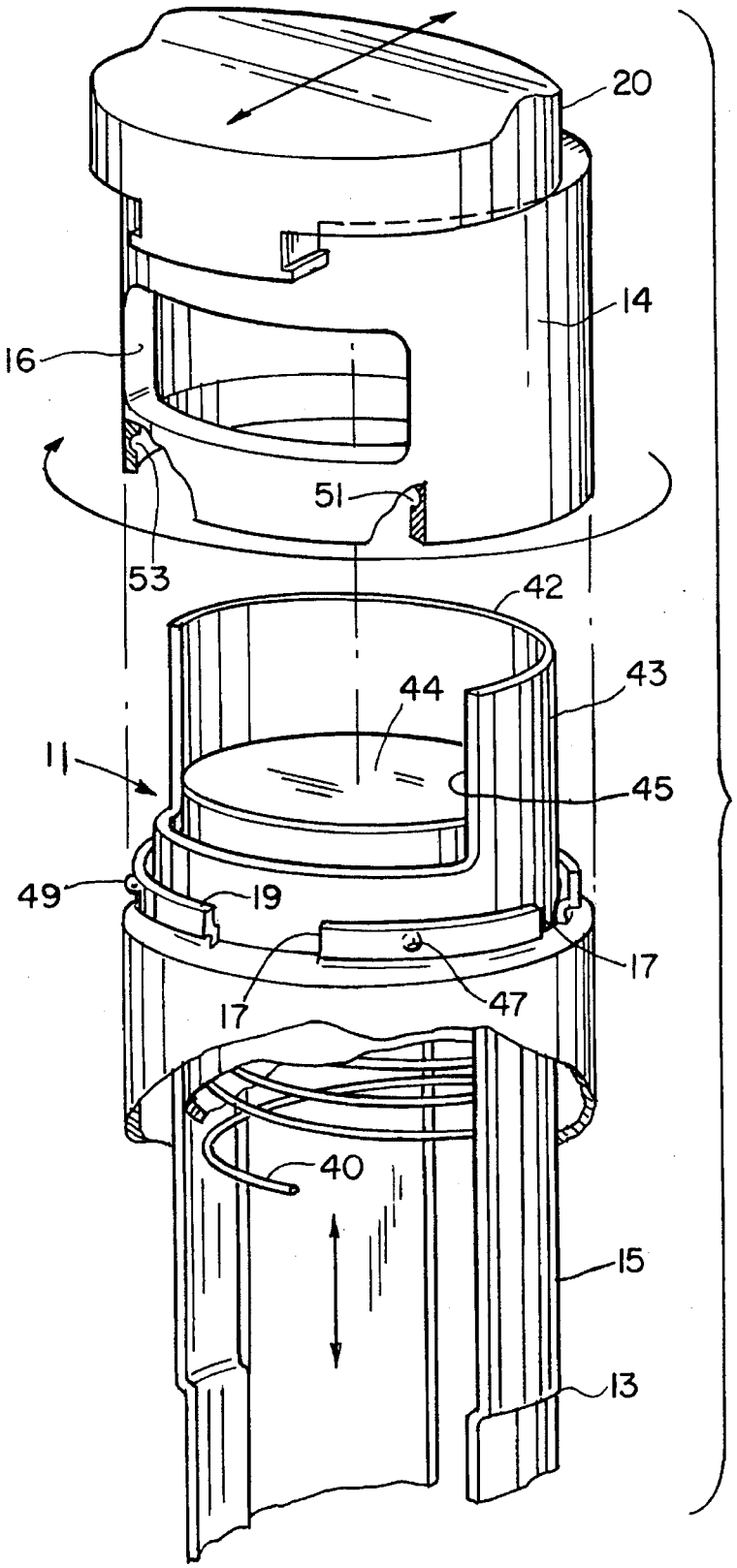
FIG. 4 is an exploded view showing the various components of the cover for the container of the dispenser of this invention.

Another feature of this invention is ridge 13, FIG. 4, on bottom portion 15 of liner 42. Ridge 13 assists the user when liner 42 is fully extended upwards because liner 42 will rest in notches 17 of ledge 19 of container 12 when liner 42 is pushed slightly to either side. This takes some of the pressure off liner 42 which is urged downward by spring 40 while tile user fills liner 42 with tablets or confections. Other means for retaining liner 42 in its extended position, however, may also be used.

As described above, cover 14, FIG. 4, rotates to seal container 12 and the contents therein. Since cover 14 rotates with respect to inner sleeve 42, a rotation of cover 14 will position slot 16 over inner sleeve wall 43 thereby sealing slot 16. When cover 14 is rotated back, slot 16 lines up with opening 45 of inner sleeve 42 for dispensing tablets as described above. Balls 47 and 49 of container 12 are received by detents 51 and 53 to releasably lock cover 14 with respect to container 12 either in the slot 16 "open" or slot 16 "closed" or "sealed" position.

In this way, the prior complicated pivoting, flip style, spring biased lid of the prior designs is eliminated. There are less component parts, manufacturing costs are lower, and the dispenser of this invention is easy to use and yet still hygienic.

Note however, that although specific features of this invention are shown in some drawings and not others, this is for convenience only as each feature may be combined with any or all of tile other features in accordance with the invention.

And, other embodiments will occur to those skilled in the art and are within the following claims:

What is claimed is:

1. A dispenser comprising:

a container having an open end and including means for urging items contained within said container proximate said open end; and a cover for said container including a slot in communication with the open end of said container, and a slidable top portion having means for dispensing an uppermost item within said container through said slot when said slidable top portion of said cover is extended, said cover being rotatable with respect to said container for covering the slot thereby sealing items within said container.

2. The dispenser of claim 1 in which said means for dispensing includes a pusher member integral with said slidable top portion.

3. The dispenser of claim 2 further including a recess for receiving said pusher member rendering it flush when the slidable top portion is retracted.

4. The dispenser of claim 1 further including means for releasably locking said cover in position whereby the slot is uncovered.

5. The dispenser of claim 4 in which said means for releasably locking includes a ball on one of said cover and said container and a complementary detent for receiving said ball on the other of said cover and said container.

6. The dispenser of claim 1 in which said slidable top portion of the cover includes a sloped portion.

7. The dispenser of claim 6 in which said sloped portion includes a friction surface.

8. The dispenser of claim 1 in which said means for urging items contained within said container proximate said open end includes a liner spring biased to retract within said container and a lift member slidable with respect to said liner, said lift member spring biased to extend out of said container.

9. The dispenser of claim 8 further including means for retaining said liner in an extended position.

10. The dispenser of claim 9 in which said means for retaining said liner includes a ledge on a bottom portion of said liner.

11. The dispenser of claim 10 in which said means for retaining further includes notches in a top portion of said container.

12. A dispenser comprising:

a container having an open end and including a liner spring biased to retract within said container and a lift member slidable with respect to said liner and spring biased to extend out of said container for urging items contained within said container proximate said open end;

a cover for said container including a slot in communication with the open end of said container and a slidable top portion having means for dispensing an uppermost item within said container through said slot when said slidable top portion of said cover is extended, said cover being rotatable with respect to said container for covering the slot thereby sealing items within said container; and means for retaining said liner in an extendable position.

* * * * *